US010173754B2

(12) United States Patent
Parniske et al.

(10) Patent No.: US 10,173,754 B2
(45) Date of Patent: Jan. 8, 2019

(54) PONTOON BOAT COVER SYSTEM

(71) Applicant: Taylor Made Group, LLC, Gloversville, NY (US)

(72) Inventors: Dennis J. Parniske, Parrish, FL (US); Robert R. Shearer, Bradenton, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 15/723,405

(22) Filed: Oct. 3, 2017

(65) Prior Publication Data

US 2018/0093742 A1 Apr. 5, 2018

Related U.S. Application Data

(60) Provisional application No. 62/403,472, filed on Oct. 3, 2016.

(51) Int. Cl.
*B63B 17/02* (2006.01)

(52) U.S. Cl.
CPC ..... *B63B 17/02* (2013.01); *B63B 2221/24* (2013.01)

(58) Field of Classification Search
CPC ..... B63B 17/02; B63B 2221/24
See application file for complete search history.

(56) References Cited

U.S. PATENT DOCUMENTS 5,016,558 A * 5/1991 Oehler ..... B63B 17/02 114/361
5,803,104 A * 9/1998 Pollen ..... B63B 17/02 114/361
5,931,114 A * 8/1999 Bartholomew ..... B63B 17/02 114/361
5,983,824 A * 11/1999 Hernandez ..... B63B 17/02 114/361
6,006,692 A * 12/1999 Szukhent, Jr. ..... B63B 17/02 114/361
6,349,666 B1 * 2/2002 Hastings ..... B63B 17/02 114/361
6,799,529 B1 * 10/2004 Willis ..... B63B 17/02 114/361
6,848,387 B1 * 2/2005 Zalanka ..... B63B 17/02 114/361
6,983,716 B1 * 1/2006 Ankney ..... B63B 17/02 114/361
7,270,075 B1 * 9/2007 Jones ..... B63B 17/02 114/361
7,373,897 B2 * 5/2008 Tufte ..... B63B 17/02 114/361
D624,000 S * 9/2010 Wilson ..... D12/317
(Continued)

*Primary Examiner* — S. Joseph Morano
*Assistant Examiner* — Jovon E Hayes
(74) *Attorney, Agent, or Firm* — Nixon & Vanderhye P.C.

(57) ABSTRACT

A cover system for a boat includes a bimini frame securable to the boat and displaceable among an open position, a storage position, and a cover position. A flexible top is coupled with the bimini frame, and a cover is positionable over the bimini frame with the bimini frame in the cover position. The bimini frame thus functions as a support structure for a mooring or trailering cover. With the described bimini frame, one cover size can fit multiple seating and deck configurations without the need for a separate cover design for the various configurations.

16 Claims, 2 Drawing Sheets

(56) References Cited

U.S. PATENT DOCUMENTS

| | | | | |
|---|---|---|---|---|
| 8,056,497 | B1 * | 11/2011 | Rondeau | B63B 17/02 114/363 |
| 8,297,484 | B2 * | 10/2012 | Jesewitz | B63B 25/002 114/343 |
| 9,120,539 | B1 * | 9/2015 | Binder | B63B 17/02 |
| 9,404,281 | B1 * | 8/2016 | Donnay | E04H 15/36 |
| 9,783,267 | B1 * | 10/2017 | Alexander | B63B 17/04 |
| 2003/0075097 | A1 * | 4/2003 | Warfel | B63B 17/02 114/361 |
| 2003/0127036 | A1 * | 7/2003 | Pastor | B63B 17/02 114/361 |
| 2006/0090685 | A1 * | 5/2006 | Fishburn | B63B 17/02 114/361 |
| 2008/0314306 | A1 * | 12/2008 | Santa Cruz | B63B 17/02 114/343 |
| 2009/0229508 | A1 * | 9/2009 | James | B63B 17/02 114/361 |
| 2010/0050923 | A1 * | 3/2010 | Lemons | B63B 17/02 114/361 |
| 2010/0083891 | A1 * | 4/2010 | Russikoff | B63B 17/02 114/361 |
| 2014/0090591 | A1 * | 4/2014 | Shearer | B63B 17/02 114/361 |
| 2014/0130728 | A1 * | 5/2014 | Parniske | B63B 17/02 114/361 |
| 2014/0261142 | A1 * | 9/2014 | Williams | B63B 17/02 114/361 |

* cited by examiner

PONTOON BOAT COVER SYSTEM

CROSS-REFERENCES TO RELATED APPLICATIONS

This application claims the benefit of U.S. Provisional Patent Application No. 62/403,472, filed Oct. 3, 2016, the entire content of which is herein incorporated by reference.

STATEMENT REGARDING FEDERALLY SPONSORED RESEARCH OR DEVELOPMENT (NOT APPLICABLE)

BACKGROUND

The invention relates to a pontoon boat cover system and, more particularly, to a boat cover system utilizing a bimini frame positionable to support the cover.

Pontoon boats typically have multiple seating and accessory options available for a single sized platform. Usually, multiple seating and accessory arrangements require boat companies to inventory several covers to accommodate the variations. Multiple cover configurations as well as multiple color combinations result in costly inventory requirements for the boat companies.

U.S. Pat. No. 7,270,075 (Jones) describes a dual purpose storage and cruising cover. Jones discusses the use of a unitary fabric cover that is used in positions one and two.

BRIEF SUMMARY

The cover system of the described embodiments covers a portion (or all of) the deck of a pontoon boat using the existing bimini frame system. A single cover pattern accommodates all of the various seating and accessories combinations for a particular sized boat. This is accomplished by creating a support structure that is above the seating, rails and accessories. The existing bimini frame is positionable into a cover position, possibly with a portion of the bimini canvas removed, and a cover material is attached to cover the desired portion of the boat deck.

In an exemplary embodiment, a cover system for a boat includes a bimini frame securable to the boat and displaceable among an open position, a storage position, and a cover position, a flexible top coupled with the bimini frame, and a cover positionable over the bimini frame with the bimini frame in the cover position. The bimini frame may include a main bow connectable to the boat and with a main cross bar, a primary tension bow pivotably coupled with the main bow and with a primary cross bar, and at least one secondary tension bow pivotably coupled with the main bow or the primary tension bow and with a secondary cross bar. In the open position, the bimini frame may be configured to support the flexible top over a cabin area of the boat. In the storage position, the main bow may be pivoted fore or aft from the open position, and the primary tension bow may be pivoted adjacent the main bow. In the cover position, the main bow may be pivoted fore or aft from the open position, the primary tension bow may be pivoted aft or fore oppositely from the main bow, and the secondary tension bow may be pivoted such that the secondary cross bar may be disposed between the main cross bar and the primary cross bar. In the cover position, a portion of the flexible top may be detached from the bimini frame.

The bimini frame may include a main bow pivotably connectable to the boat, a primary tension bow pivotably coupled with the main bow, and at least one secondary tension bow pivotably coupled with the main bow or the primary tension bow. A main bow bimini stanchion may be pivotably coupled with the main bow and extendable between the main bow and the boat in the open position. A primary tension bow bimini stanchion may be pivotably coupled with the primary tension bow and extendable between the primary tension bow and the boat in the open position. A main bow cover stanchion may be pivotably coupled with the main bow and extendable between the main bow and the boat in the cover position. The bimini frame may further include a primary tension bow cover stanchion pivotably coupled with the primary tension bow and extendable between the primary tension bow and the boat in the cover position. In some embodiments, the bimini frame may include two secondary tension bows coupled with the main bow and the primary tension bow, respectively. The cover system may include at least one tent pole support attachable to the boat and coupled with the at least one secondary tension bow in the cover position. The cover system may include two tent pole supports attachable to the boat and respectively coupled with the two secondary tension bows in the cover position.

In another exemplary embodiment, a cover system for a boat includes a bimini frame securable to the boat and displaceable among an open position, a storage position, and a cover position. The bimini frame may include a main bow pivotably connectable to the boat, a primary tension bow pivotably connected to the main bow, a pair of first stanchions connectable in the open position between the main bow and the boat and between the primary tension bow and the boat, respectively, and a pair of second stanchions connectable in the cover position between the main bow and the boat and between the primary tension bow and the boat, respectively. The cover system may also include a flexible top coupled with the bimini frame, and a cover positionable over the bimini frame with the bimini frame in the cover position. The bimini frame may include at least one secondary tension bow pivotably connected to at least one of the main bow and the primary tension bow. In this context, the cover system may also include at least one tent pole support attachable to the boat and coupled with the at least one secondary tension bow in the cover position. In the open position, the at least one tent pole support may be pivoted to a storage position or may be removed. In the open position, the second stanchions may be disposed adjacent the first stanchions, respectively.

In yet another exemplary embodiment, a bimini frame is securable to a boat and includes a main bow pivotably connectable to the boat, a primary tension bow pivotably connectable to the boat or pivotably connected to the main bow, and at least one secondary tension bow pivotably coupled with a corresponding at least one of the main bow and the primary tension bow. The bimini frame may be configurable among an open position, a storage position, and a cover position, and in the cover position, a pivot angle between the main bow and the primary tension bow may be greater than that in the open position.

BRIEF DESCRIPTION OF THE DRAWINGS

These and other aspects and advantages will be described in detail with reference to the accompanying drawings, in which.

DETAILED DESCRIPTION

A bimini top is traditionally an open-front cover assembly including a top made of canvas or other suitable material for the cockpit of a vehicle such as a boat. The bimini frame is secured to the boat or boat deck at various points of contact and is typically displaceable between an open position and a storage position.

Figure 1:
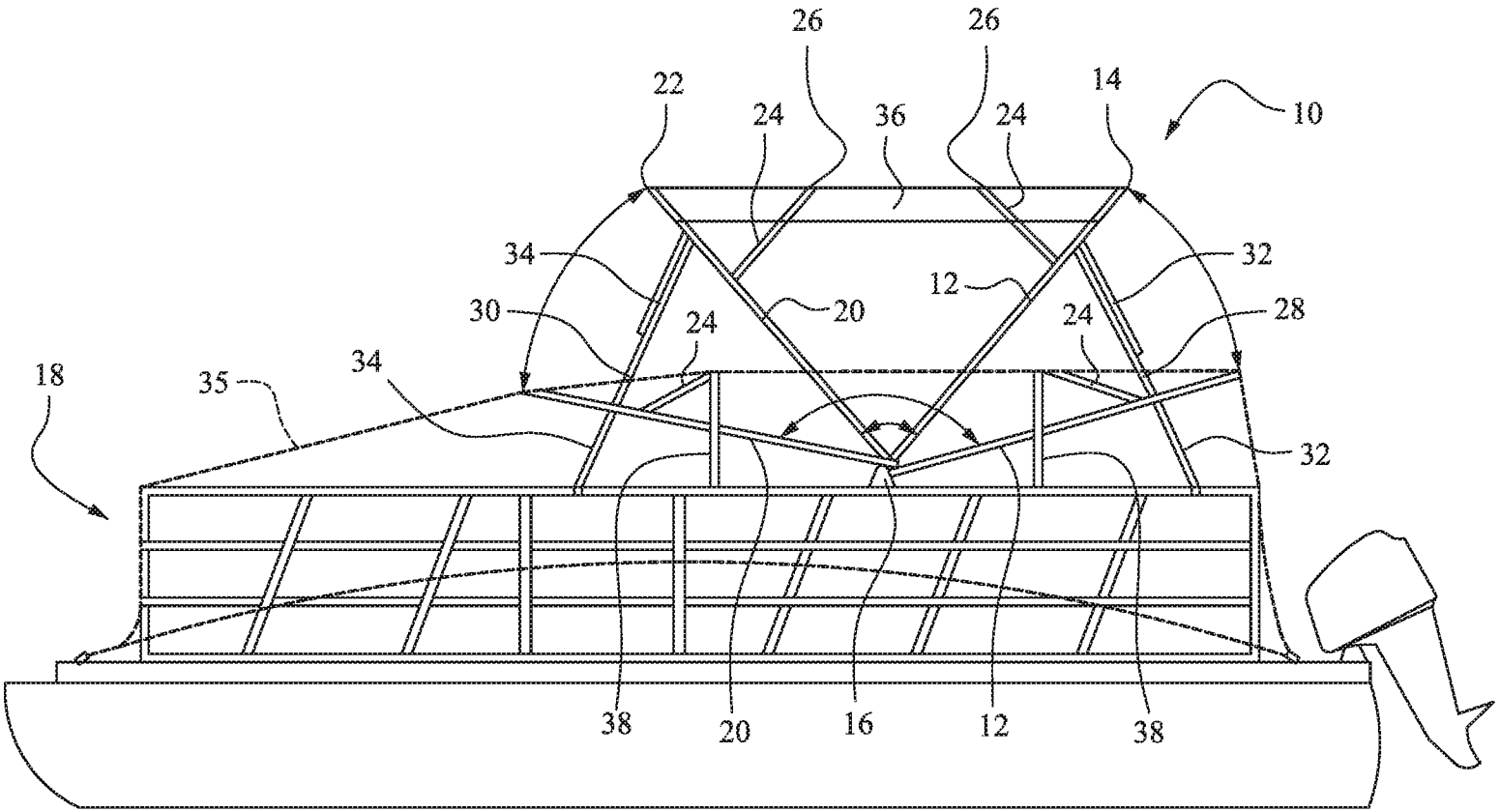
FIG. 1 shows the cover system in an open position for use as a traditional bimini and a cover position for supporting a boat cover.

FIG. 1 shows a bimini top assembly including a bimini frame 10. The bimini frame 10 according to the described embodiments is displaceable into a "cover" position in addition to the conventional open and storage positions.

With reference to FIG. 1, the bimini frame 10 includes a main bow 12 connectable to the boat and including a main crossbar 14. The main bow 12 is preferably pivotably attached to the boat at a pivot joint 16 or the like, which may be attached to an existing railing 18 on the boat. A primary tension bow 20 is pivotably coupled with either the main bow 12 or the pivot joint 16 and includes a primary crossbar 22. As shown in FIG. 1, the main bow 12 is an aft bow, and the primary tension bow 20 is a forward bow. As would be appreciated by those of ordinary skill in the art, these bows could be reversed depending on design and storage position preferences.

The frame 10 may also be provided with at least one secondary tension bow 24 pivotably coupled with the main bow 12 and/or the primary tension bow 20. The secondary tension bow(s) 24 include a corresponding secondary crossbar 26. The bows 12, 20, 24 and respective crossbars 14, 22, 26 support a flexible top or cover 36 over a cockpit area of the boat when the frame 10 is in its open position.

The frame 10 also includes a main bow bimini stanchion or aft stanchion 28 that is pivotably coupled with the main bow 12 and is extendable between the main bow 12 and the boat in the open position as shown in FIG. 1. A primary tension bow bimini stanchion or forward stanchion 30 may be pivotably coupled with the primary tension bow 20 and extendable between the primary tension bow 20 and the boat in the open position. The frame 10 also includes a main bow cover stanchion 32 and a primary tension bow cover stanchion 34. In the open position, the cover stanchions 32, 34 may be disposed adjacent the bimini stanchions 28, 30.

FIG. 1 also shows the bimini frame 10 in its cover position. That is, the bimini frame 10 according to the described embodiments is displaceable into the cover position in which the frame 10 can support a boat cover 35 above the seating, rails and accessories of the boat. As such, there is no need to provide cutouts around the accessories, bimini frame etc. as required by existing boat covers.

With continued reference to FIG. 1, in the cover position, at least a portion of the flexible top 36 may be removed from one or more of the bows 12, 20, 24, and the bimini stanchions 28, 30 are detached from the boat and pivoted to a storage position. The main bow 12 and the primary tension bow 20 are spread/pivoted to the cover position and are supported by the cover stanchions 32, 34, respectively. That is, the cover stanchions 32, 34 are connected between the main bow 12 and the primary tension bow 20 and the boat, respectively. As shown, in this position, a pivot angle between the main bow 12 and the primary tension bow 20 in the cover position is greater than the pivot angle in the open position.

The assembly may also be provided with at least one tent pole support 38 attachable to the boat and supporting one or both of the secondary tension bows 24 in the cover position. The tent pole supports 38 may be attached to the boat railing 18. With the frame 10 in the open position, the one or more tent pole supports 38 may be pivoted to a storage position or removed. The crossbars 26 of the secondary tension bows 24 further support the boat cover with the frame 10 in the cover position. Thus, in the cover position, the main bow 12 is pivoted (aft in FIG. 1) from the open position, and the primary tension bow 20 is pivoted (forward in FIG. 1) oppositely from the main bow 12. The secondary tension bow 24 is pivoted such that the secondary crossbar 26 is disposed between the main crossbar 14 and the primary crossbar 22.

Figure 2:
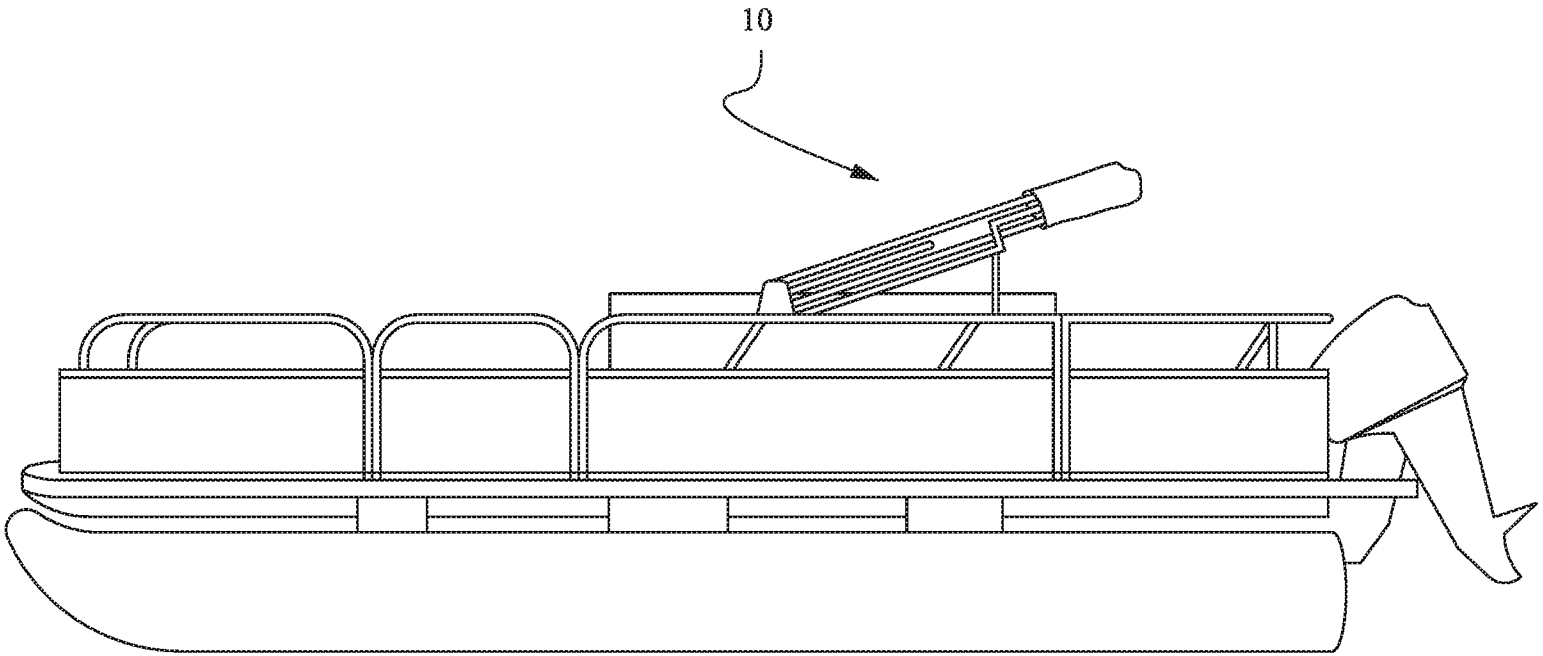
FIG. 2 shows the cover system in a storage/trailering position.

With reference to FIG. 2, in the storage position, the main bow 12 is pivoted forward or aft from the open position, and the primary tension bow 20 is pivoted adjacent the main bow 12. In the storage position, all of the bimini frame 10 components may be folded onto one another and supported by one of the tent pole supports 38.

The described bimini frame functions as a support structure for a mooring or trailering cover. With the described bimini frame, one cover size can fit multiple seating and deck configurations without the need for a separate cover design for different configurations.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A cover system for a boat comprising:

a bimini frame securable to the boat and displaceable among an open position, a storage position, and a cover position;

a flexible top coupled with the bimini frame; and a cover positionable over the bimini frame with the bimini frame in the cover position, wherein the bimini frame comprises a main bow connectable to the boat and including a main cross bar, a primary tension bow pivotably coupled with the main bow and including a primary cross bar, and at least one secondary tension bow pivotably coupled with the main bow or the primary tension bow and including a secondary cross bar, and wherein in the cover position, the main bow is pivoted fore or aft from the open position, the primary tension bow is pivoted aft or fore oppositely from the main bow, and the secondary tension bow is pivoted such that the secondary cross bar is disposed between the main cross bar and the primary cross bar.

2. A cover system according to claim 1, wherein in the open position, the bimini frame is configured to support the flexible top over a cabin area of the boat, and wherein in the storage position, the main bow is pivoted fore or aft from the open position, and the primary tension bow is pivoted adjacent the main bow.

3. A cover system according to claim 2, wherein in the cover position, a portion of the flexible top is detached from the bimini frame.

4. A cover system according to claim 1, wherein in the cover position, a portion of the flexible top is detached from the bimini frame.

5. A cover system for a boat comprising:

a bimini frame securable to the boat and displaceable among an open position, a storage position, and a cover position;

a flexible top coupled with the bimini frame; and a cover positionable over the bimini frame with the bimini frame in the cover position, wherein the bimini frame comprises:

a main bow pivotably connectable to the boat;

a primary tension bow pivotably coupled with the main bow;

at least one secondary tension bow pivotably coupled with the main bow or the primary tension bow;

a main bow bimini stanchion pivotably coupled with the main bow and extendable between the main bow and the boat in the open position;

a primary tension bow bimini stanchion pivotably coupled with the primary tension bow and extendable between the primary tension bow and the boat in the open position; and a main bow cover stanchion pivotably coupled with the main bow and extendable between the main bow and the boat in the cover position.

6. A cover system according to claim 5, wherein the bimini frame further comprises a primary tension bow cover stanchion pivotably coupled with the primary tension bow and extendable between the primary tension bow and the boat in the cover position.

7. A cover system according to claim 6, wherein the bimini frame comprises two secondary tension bows coupled with the main bow and the primary tension bow, respectively, the cover system further comprising two tent pole supports attachable to the boat and respectively coupled with the two secondary tension bows in the cover position.

8. A cover system according to claim 5, further comprising at least one tent pole support attachable to the boat and coupled with the at least one secondary tension bow in the cover position.

9. A cover system for a boat comprising:

a bimini frame securable to the boat and displaceable among an open position, a storage position, and a cover position, the bimini frame including a main bow pivotably connectable to the boat, a primary tension bow pivotably connected to the main bow, a pair of first stanchions connectable in the open position between the main bow and the boat and between the primary tension bow and the boat, respectively, and a pair of second stanchions connectable in the cover position between the main bow and the boat and between the primary tension bow and the boat, respectively;

a flexible top coupled with the bimini frame; and a cover positionable over the bimini frame with the bimini frame in the cover position.

10. A cover system according to claim 9, wherein the bimini frame further comprises at least one secondary tension bow pivotably connected to at least one of the main bow and the primary tension bow, the cover system further comprising at least one tent pole support attachable to the boat and coupled with the at least one secondary tension bow in the cover position.

11. A cover system according to claim 10, wherein in the open position, the at least one tent pole support is pivoted to a storage position or is removed.

12. A cover system according to claim 9, wherein in the cover position, a portion of the flexible top is detached from the bimini frame.

13. A cover system according to claim 9, wherein in the open position, the second stanchions are disposed adjacent the first stanchions, respectively.

14. A bimini frame securable to a boat, the bimini frame comprising:

a main bow pivotably connectable to the boat;

a primary tension bow pivotably connectable to the boat or pivotably connected to the main bow; and at least one secondary tension bow pivotably coupled with a corresponding at least one of the main bow and the primary tension bow, wherein the bimini frame is configurable among an open position, a storage position, and a cover position, and wherein in the cover position, a pivot angle between the main bow and the primary tension bow is greater than that in the open position.

15. A bimini frame according to claim 14, further comprising a pair of first stanchions connectable in the open position between the main bow and the boat and between the primary tension bow and the boat, respectively, and a pair of second stanchions connectable in the cover position between the main bow and the boat and between the primary tension bow and the boat, respectively.

16. A bimini frame according to claim 15, wherein in the open position, the second stanchions are disposed adjacent the first stanchions, respectively.

* * * * *